US005947018A

United States Patent [19]

Sloat et al.

[11] Patent Number: 5,947,018

[45] Date of Patent: Sep. 7, 1999

[54] MECHANICAL PRESS WITH CAM DRIVE

[75] Inventors: Gerrit W. Sloat, Grand Blanc; Gerald A. Brown, Roseville; Donald D. Pagels, Grosse Pointe Woods; Wenjia Cai, Warren; William M. Faitel, Oxford, all of Mich.

[73] Assignee: Unova IP Corp., Beverly Hills, Calif.

[21] Appl. No.: 08/918,246

[22] Filed: Aug. 25, 1997

[51] Int. Cl.[6] ..... B30B 1/06; B30B 1/18; B30B 1/26

[52] U.S. Cl. ..... 100/283; 72/450; 72/452.3; 72/453.03; 72/454; 100/271; 100/289; 100/291

[58] Field of Search ..... 100/271, 272, 100/281, 283, 289, 291, 293; 72/450, 452.1, 452.2, 452.3, 452.8, 453.03, 454

[56] References Cited

U.S. PATENT DOCUMENTS

| | | | |
|---|---|---|---|
| 136,422 | 3/1873 | Derden | 100/293 |
| 955,623 | 4/1910 | Welch | 72/450 |
| 966,412 | 8/1910 | Alinder | 72/450 |
| 2,298,852 | 10/1942 | Ward | 100/272 |
| 2,443,573 | 6/1948 | Brundage | 100/271 |
| 2,600,242 | 6/1952 | May | 100/283 |
| 2,664,191 | 12/1953 | May | 72/450 |
| 3,140,654 | 7/1964 | Jewett | 100/272 |
| 4,846,056 | 7/1989 | Bond | 100/281 |
| 4,956,992 | 9/1990 | Undin | 100/281 |
| 5,272,903 | 12/1993 | Evans | 100/271 |
| 5,315,855 | 5/1994 | Jackson | 72/452.3 |
| 5,709,125 | 1/1998 | Nakazawa et al. | 100/283 |

*Primary Examiner*—Stephen F. Gerrity
*Attorney, Agent, or Firm*—Reising, Ethington, Barnes, Kisselle, Learman & McCulloch, P.C.

[57] ABSTRACT

A mechanical press has a ram carried by a frame and movable to advanced and retracted positions by a ball screw assembly driven by a reversible motor to actuate a cam and follower assembly connected to the ram by a linkage system. The linkage system has a pair of pivot links pivotally connected at one end to a fixed pivot shaft connected to the press frame and connected at their opposite end to a follower nut for movement thereby as the follower nut travels along the length of the driven screw. A pair of roller followers are also driven by the follower nut to move between first and second positions within cam tracks formed in a pair of first lever arms operably connected to the ram. In use, when the motor drives the screw in one direction the first lever arms are rotated in one direction to move the ram to its advanced position wherein the ram urges a die or tool into engagement with a workpiece. When the motor is reversed, the first lever arm is rotated in the opposite direction to move the ram to its retracted position to disengage the die or tool from the workpiece.

21 Claims, 4 Drawing Sheets

MECHANICAL PRESS WITH CAM DRIVE

FIELD OF THE INVENTION

This invention relates generally to a forming press and more particularly to a mechanical press utilizing a cam linkage drive.

BACKGROUND OF THE INVENTION

A forming press may be used to perform various forming operations on a sheet metal workpiece such as piercing, timing, flanging, forming and the like. To provide the necessary force to the press die or tool acting on the metal workpiece, some previous forming presses have utilized a fluid actuated cylinder under pressure, such as a pneumatic or hydraulic cylinder. Fluid cylinders, whether pneumatic or hydraulic, require highly effective seals to prevent leakage of the fluid under pressure. Contaminants adjacent the cylinder can degrade or destroy the seals resulting in fluid leaks which cause a reduced output force of the press or failure of the press. This may require replacement of the seal or, in some cases, the entire fluid cylinder. Thus, the fluid actuated cylinders are not durable, are somewhat expensive, and due to leakage may provide a decreasing force to the press ram over the life of the cylinder thereby affecting the performance of the press.

Still further, fluid actuated cylinders, in order to provide sufficient force to the press rain are generally quite large and relatively slow in operation. There are many constraints on the size of the cylinders for instance, the high pressure required for the necessary output and the high temperatures of the cylinder in use, among other factors which occur during use of the cylinders.

SUMMARY OF THE INVENTION

A mechanical press has a ram carried by a frame and movable to advanced and retracted positions by a ball screw assembly driven by an actuator, such as a reversible motor, to actuate a cam and follower assembly connected to the ram by a linkage system. The linkage system has a pair of pivot links pivotally connected at one end to a fixed pivot shaft connected to the press frame and connected at the opposite end to a follower nut for movement thereby as the follower nut travels along the length of the driven screw. A pair of roller followers are also driven by the follower nut to move between first and second positions within cam tracks formed in a pair of first lever arms operably connected to the ram. In use, when the motor drives the screw in one direction the first lever arms are rotated in one direction to move the ram to its advanced position wherein the ram urges a die or tool into engagement with a workpiece. When the motor is reversed, the first lever arms are rotated in the opposite direction to move the ram to its retracted position to disengage the die or tool from the workpiece.

The linkage is designed to maximize the mechanical advantage of the press in its advanced position thereby providing maximum force in that position to form the workpiece. The linkage system is also designed to have a lower mechanical advantage when the press is moved adjacent its retracted position to thereby increase the speed of the press when retracting from the workpiece and decrease the force applied to the ram to increase the efficiency of the system. Thus, the press has its highest force and lowest speed adjacent the advanced position to provide a controlled high force acting on the workpiece, and a lower force and higher speed adjacent its retracted position to rapidly retract the ram from the workpiece to reduce the stress on the motor and linkage assembly and increase the speed and efficiency of the press.

Objects, features and advantages of this invention include providing a mechanical press which utilizes a linkage assembly to provide a strategically varied force and speed of the press ram in use when driven by a motor with a constant output speed in two opposed directions, provides a maximum force and controlled speed when forming the workpiece, provides a reduced force and increased speed when retracting the ram from the workpiece and when initially advancing the ram toward the workpiece, enables use of a smaller actuator, comprises a completely mechanical Linkage driven by an electric motor, is not dependent on the integrity of a high pressure seal as in a fluid cylinder, provides substantially the same output force throughout its life, is extremely compact, rugged, durable, of relatively simple design and economical manufacture, and in service, has a long useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
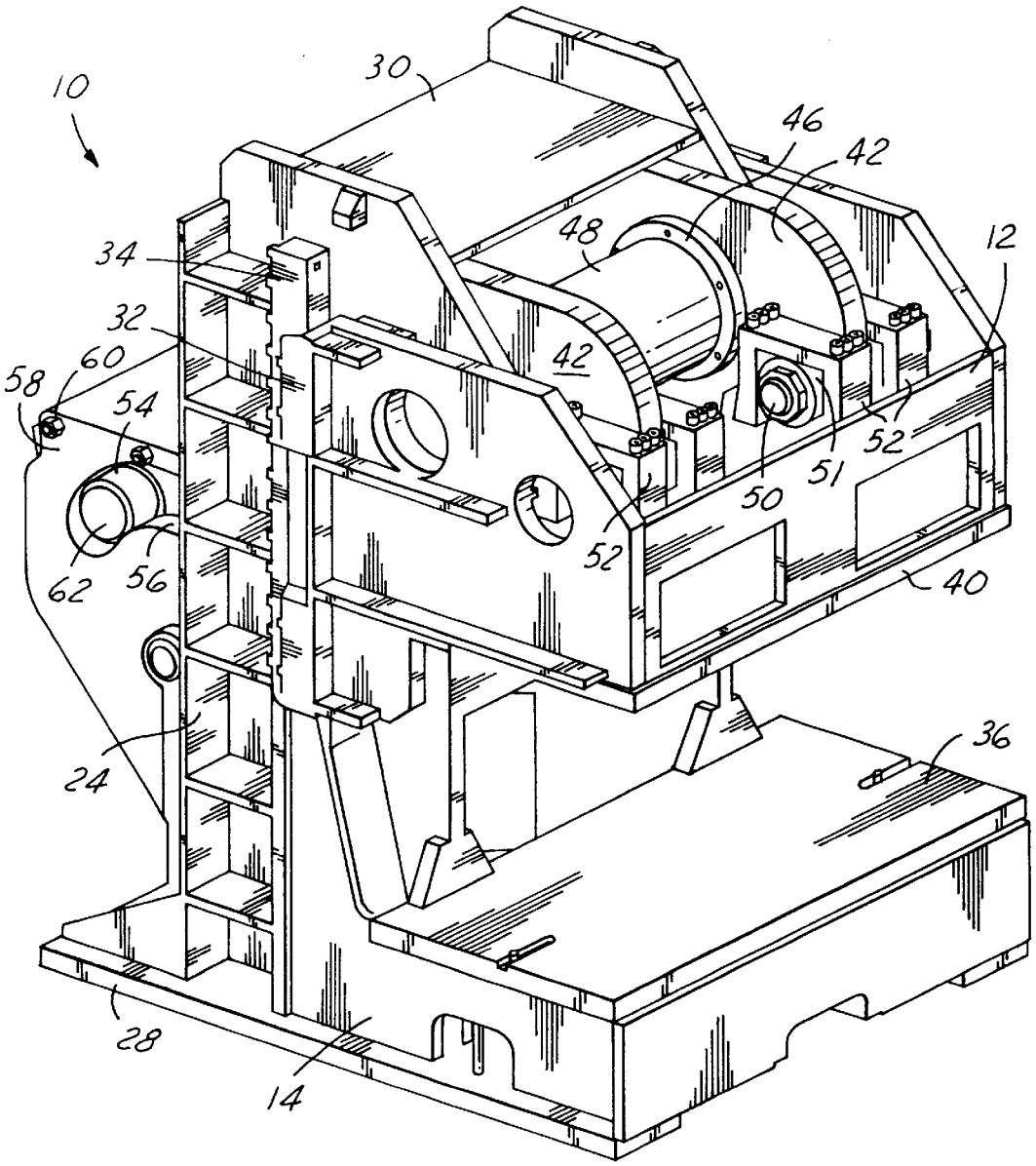
FIG. 1 is a perspective view of a mechanical forming press in accordance with the present invention.

Referring in more detail to the drawings, FIGS. 1–4 illustrate a mechanical press 10 embodying this invention with a ram 12 carried by a frame 14 and movable to advanced and retracted positions by a ball screw assembly 16 driven by an actuator, such as a reversible electric motor 18, to actuate a cam and follower assembly 20 connected to the ram 12 by a linkage system 22. Alternatively, the actuator may be a hydraulic or pneumatic cylinder or ram.

The frame 14 has a pair of laterally spaced apart and upright side members 24 fixed to a base plate 28 and interconnected by transverse plates 30. A slide 32 is mounted for reciprocation on the frame 14 by a pair of ways 34 each secured to one of the side members 24. A lower platen 36 is fixed to the bed of the press 10 and an upper platen 40 is fixed to the ram 12 for movement toward and away from the lower platen 36. Typically, upper and lower forming dies or other tooling are mounted on the platens 36, 40 and moved to open and closed positions by reciprocation of the ram 12.

The linkage system 22 has a pair of first lever arms 42 interconnected by a spacer tube 44 and journaled by bearings 46 to pivot on a first shaft 48 carried by the side members 24 of the frame 14. Adjacent one end, the lever arms 42 are pivotally connected to the ram 12 by pins 50 received and carried by journal blocks 51 carried by slides 52 fixed to the ram 12. The slides 52 permit horizontal movement of the pivots in response to rotation of the arms. This horizontal movement is along a path perpendicular to the path of movement of the ram.

The cam and follower assembly 20 has a pair of roller followers 54 each received in a separate cam track 56 formed in plates 58 secured by cap screws 60 to the first lever arms 42. Each roller follower 54 is journalled on a stub shaft 62 received and journalled adjacent one end on a pair of pivot links 64 journaled about a pivot shaft 66 adjacent their other end by bearings 68 on a pair of carrier plates 70 fixed to the frame 14. Preferably, the cam tracks 56 are formed in separate plates 58 mounted on the first lever arms 42 so that the contour of the cam tracks 56 can be readily changed to adapt the press to different applications and to facilitate repair or replacement of any worn cam tracks.

The ball screw assembly 16 has a follower nut 72 connected to the stub shafts 62 journaling the roller followers 54 and received on a drive screw 74 driven by the reversible motor 18 and journaled for rotation in a housing 76 pivotally mounted by bearings 78 on stub shafts 79 received through the carrier plates 70. To provide the preferred linkage geometry, the motor 18 is mounted such that when the pivot links 64 are at the midpoint of their travel, the screw 74 is generally perpendicular to the pivot links 64 so that the force is applied generally along the axis of the screw 74. The motor 18 may be a stepper motor which is connected to the screw 74 through a clutch 75 or other torque limiting device which limits the maximum torque applied to the screw 74 and hence the ram 12 to prevent damage to the press mechanism and at high speeds it may slip somewhat due to the reduced mechanical advantage of the mechanism. This clutch arrangement preferably provides an essentially constant maximum output torque or force applied to the follower nut 72 and roller follower 54.

Operation of the Press

Figure 2:
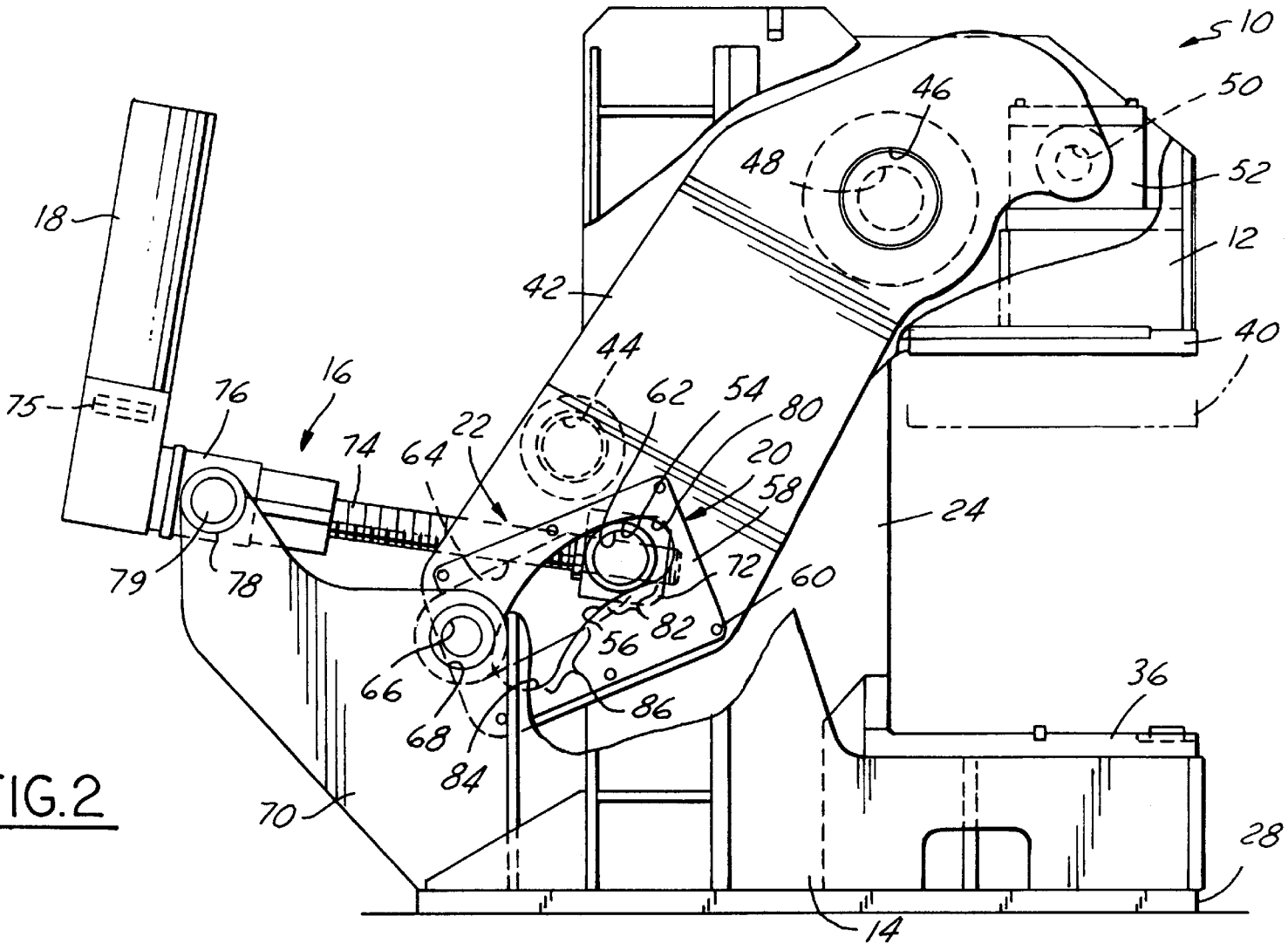
FIG. 2 is a side view of the press embodying this invention in its retracted position.

In FIG. 2, the press 10 is shown in its fully retracted position wherein the ram 12 is at the top of the slides 32. In this position, the follower nut 72 has been driven to the free end of the drive screw 74 by the motor 18 and thus, the roller followers 54 connected to the follower nut 72 via the shafts 62 have been moved in the cam track 56 towards a first end 80 of the cam tracks 56. In this position the roller followers 54 bear on a first portion 82 of the cam tracks 56 thereby tending to rotate the first lever arms 42 counterclockwise about the first shaft 48 to move the upper platen 40 away from the lower platen 36.

Figure 3:
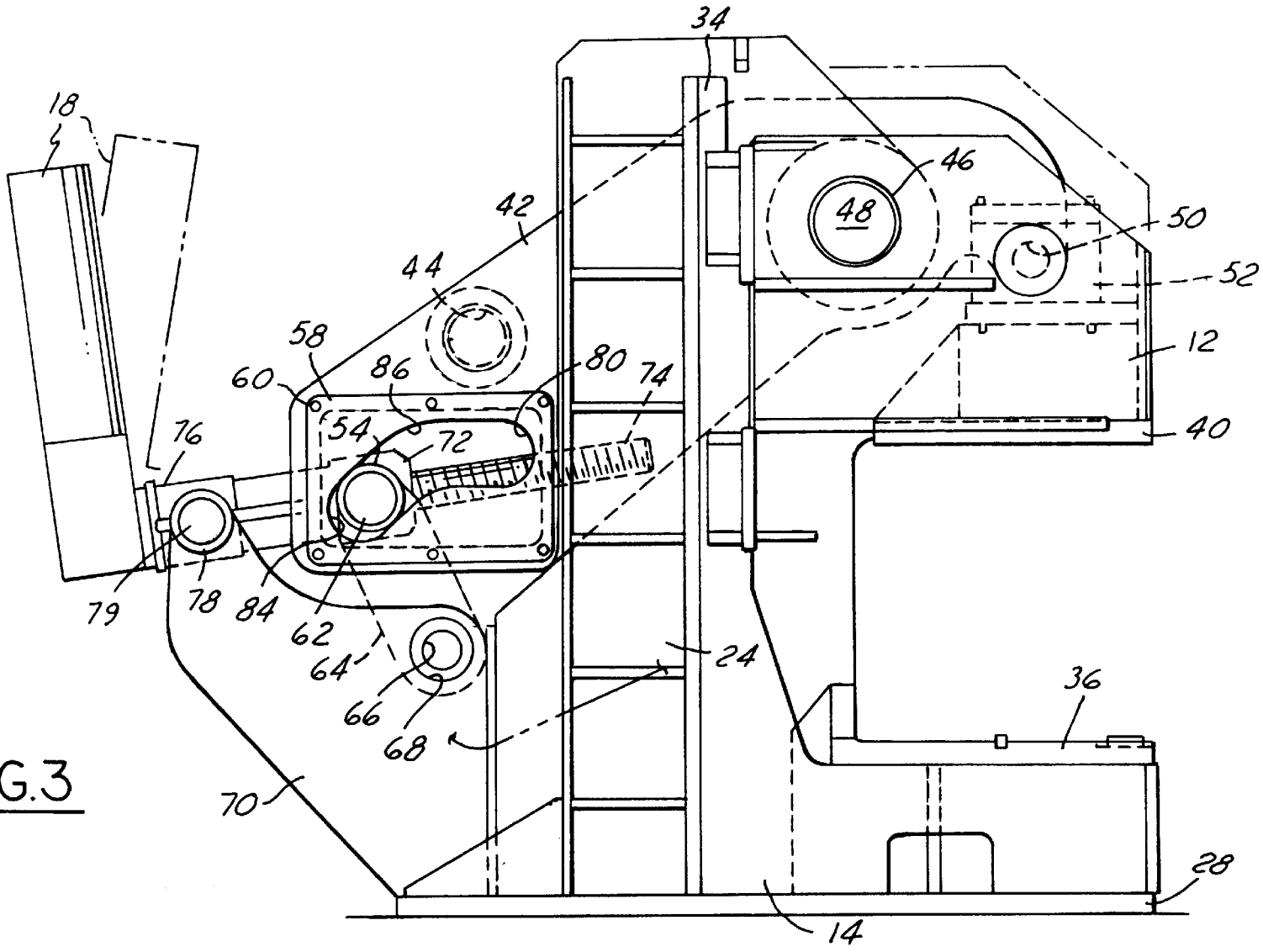
FIG. 3 is a schematic view of the press in its extended position.
Figure 4:
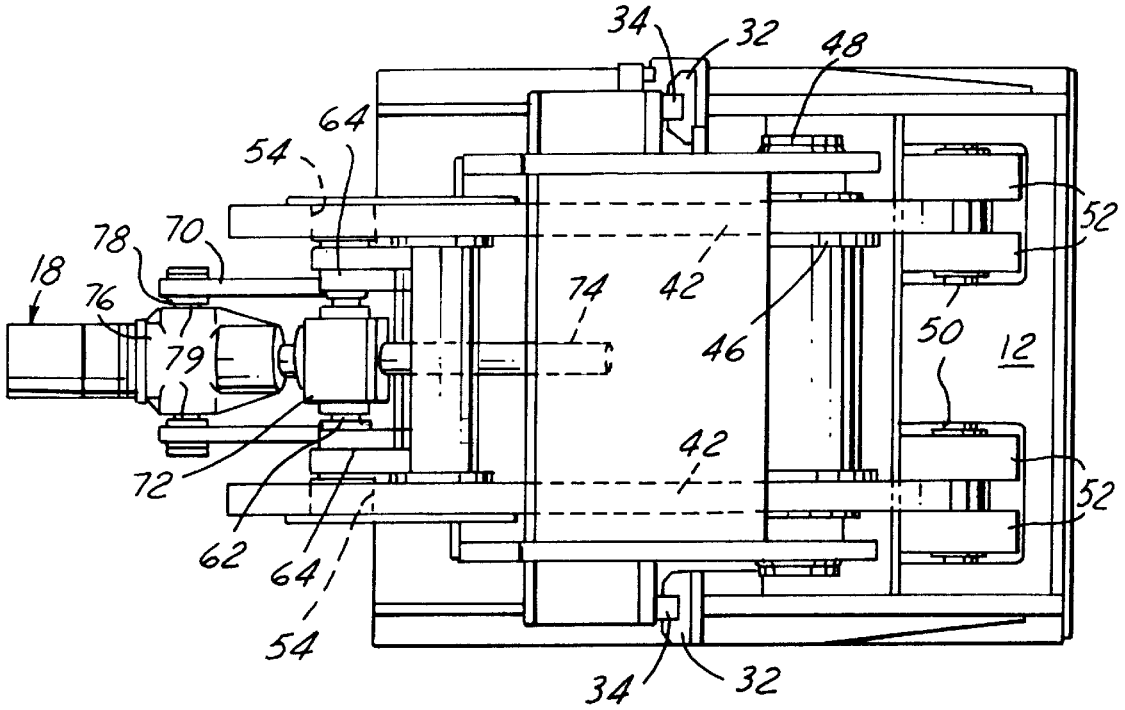
FIG. 4 is a top view of the press.

To move the ram 12 from its retracted position to its advanced position as shown in FIG. 3, the motor 18 is energized to rotate the drive screw 74 in a direction wherein the follower nut 72 travels towards the motor 18 thereby moving the roller followers 54 towards the second end 84 of each cam track 56 and rotating the pivot links 64 counterclockwise about the pivot shaft 66. In this position, the roller followers 54 bear on the second portion 86 of each cam track 56 to rotate the first lever arms 42 clockwise about the first shaft 48 to advance the ram 12 and hence the upper platen 40 towards the lower platen 36 to close the dies disposed on the platens 36, 40 and thereby form the workpiece disposed between the dies.

When moved between its retracted and advanced positions, the mechanical advantage of the press 10 changes due to a number of factors. First, the effective length of the first lever arm, 42 from the point of contact of the roller followers 54 within the cam tracks 56 to the first shaft 48 is increased in the advanced position compared to the retracted position. The increased effective length of the lever arms 42 provides an increased mechanical advantage to increase the force applied to the dies when forming the workpiece.

A second factor is the different slopes of the first and second portions 82, 86 of each cam track 56 which are engaged by the roller followers 54 when the ram 12 is moved adjacent its retracted and advanced positions, respectively. When adjacent the retracted position of FIG. 2, the roller followers 54 engage the first portion 82 of each cam track 56 which has an increasing and relatively steep slope through approximately the first half of the roller follower 54 movement within the cam track 56 which provides an increased rate of displacement of the first lever arm 42 when acted on by the roller followers 54. This increased displacement provides an increased speed of movement of 20 the first lever arm 42 and hence, the ram 12. Conversely, when adjacent to the advanced position of FIG. 3, the roller followers 54 bear on the second portion 86 of the cam track 56 which has a gradually sloped surface and provides a relatively slow speed of movement of the lever arm 42 and an increased force applied to the lever arm 42 and hence to the ram 12 to more slowly and forcefully move the ram 12. Preferably, the cam track 56 is constructed and arranged to provide a constant output force for a constant input force through approximately the last inch of travel of the roller follower 54 adjacent the fully advanced position of the ram 12 to control the maximum force of the press 10 as a function of the maximum input force which is limited by the clutch 75.

A third factor which accounts for the change in mechanical advantage is the relative position of the pivot shaft 66, the path of movement of the pivot links 64, and the orientation of the cam tracks 56. The cam tracks 56 are generally parallel to the path of movement of the pivot links 64 when the ram 12 is adjacent its advanced position. Thus, a given rotational movement of the pivot links 64 provides relatively little rotational movement of the lever arms 42. Conversely, the path of movement of the pivot links 64 is more inclined to the cam tracks 56 when the ram 12 is adjacent its retracted position. Therefore, the same increment of rotational movement of the pivot links 64 provides an increased rotational movement of the lever arms 42 adjacent the filly retracted position of the ram relative to the fully advanced position of the ram.

Thus, the lever arms 42, pivot links 64 and the cam track 56 are designed to each provide an increased mechanical advantage when the ram 12 is adjacent its advanced position to provide an increased force to the ram 12 while moving it at a slower speed towards its fully advanced position and when initially retracting the ram 12 from its fully advanced position. Additionally, the lever arms 42, pivot links 64 and cam track 56 provide a decreased mechanical advantage and an increased speed of movement of the ram when the ram 12 is adjacent its retracted position. The mechanical advantage of the press 10 can be further enhanced by providing a motor 18 which has variable output speeds and/or forces adjacent the advanced and retracted positions of the ram.

We claim:

1. A mechanical press comprising:

a frame having a bed;

a ram carried by the frame for reciprocal movement toward and away from the bed;

a first pivot carried by the frame;

at least one first arm constructed to rotate about the first pivot to drive the ram;

a second pivot carried by the frame;

an actuator; and at least one pivot link each having one end pivotally connected to the second pivot and the other end operably connected to the actuator and slidably and pivotally associated with the first arm whereby the actuator drives the pivot link to rotate about the second pivot which drives the first arm to rotate it about the first pivot and move the ram between advanced and retracted positions.

2. The press of claim 1 wherein the actuator comprises an electric motor, a screw driven to rotate by the motor and a follower received on the screw to axially travel along the screw when the screw rotates and the pivot link is operably connected to the follower.

3. The press of claim 2 wherein the motor operates at a constant force in both forward and reverse directions.

4. The press of claim 2 which also comprises a clutch coupled with the motor to limit the output torque of the motor applied to the screw to prevent damage to it and to the ram.

5. The press of claim 1 wherein the ram reciprocates along a generally linear path between the advanced and retracted positions and the pivot link is generally parallel to the path when the ram is in its advanced position.

6. The press of claim 1 wherein the pivot link rotates in a first direction about the second pivot when the ram moves from its retracted position to its advanced position causing the first arm to rotate in a second direction, opposite to the first direction, about the first pivot.

7. The press of claim 1 wherein the first arm has opposed ends with the first pivot disposed between them and the pivot link is associated with the first arm generally adjacent one end and the other end of the first arm is adjacent the ram.

8. The press of claim 7 wherein the first pivot is disposed closer to the end of the first arm adjacent the ram than to the opposite end of the first arm.

9. The press of claim 1 which also comprises a cam track carried by the first arms a roller follower received in the cam track, and a shaft connecting the pivot link and the roller follower to operably associate the pivot link with the first arm so that as the pivot link rotates about the second pivot the roller follower moves relative to the first arm within the cam track and bears on the first arm through the cam track to cause the first arm to rotate about the first pivot.

10. The press of claim 9 wherein the distance between the roller follower and the first pivot is greater when the ram is in its advanced position than when the ram is in its retracted position to provide an increased mechanical advantage of the press when the ram is adjacent its advanced position.

11. The press of claim 9 wherein the cam track has a surface which is constructed to be engaged by the roller follower when the ram is moved adjacent its retracted position to provide a relatively rapid rotation of the first arm and hence a relatively rapid displacement of the ram.

12. The press of claim 9 wherein the cam track has a surface which is engaged by the roller follower when the ram is moved adjacent to its advanced position and is constructed to provide a relatively small displacement of the first arm, and hence, the ram when the ram is adjacent its advanced position.

13. The press of claim 9 wherein the cam track is formed in a plate operably and removably connected to the first arm.

14. The press of claim 1 which also comprises a third pivot carried by the frame, the actuator is pivotally received on the third pivot to allow pivotal movement of the actuator.

15. A mechanical press comprising:

a frame having a bed;

a ram carried by the frame for reciprocal movement toward and away from the bed;

a first pivot carried by the frame;

at least one first arm constructed to rotate about the first pivot to drive the ram;

a second pivot carried by the frame;

an electric motor;

a screw driven to rotate by the motor;

a follower received on the screw to axially travel along the screw when the screw rotates; and at least one pivot link each having one end operably connected to the follower and sidably and pivotally associated with the first arm and having its other end pivotally connected to the second pivot whereby the motor rotates the screw to drive the follower along the screw thereby causing the pivot link to rotate about the second pivot which drives the first arm to rotate it about the first pivot and move the ram between advanced and retracted positions.

16. The press of claim 15 wherein the pivot link rotates in a first direction about the second pivot when the ram moves from its retracted position to its advanced position causing the first arm to rotate in a second direction, opposite to the first direction, about the first pivot.

17. The press of claim 15 wherein the first arm has opposed ends with the first pivot disposed between them and the pivot link is associated with the first arm generally adjacent on end of the first arm and the other end of the first arm is adjacent the ram.

18. The press of claim 17 wherein the first pivot is disposed closer to the end of the first arm adjacent the ram than the opposite end of the first arm.

19. The press of claim 15 which also comprises a cam track carried by the first arms a roller follower received in the cam track, and a shaft connecting the pivot link and the roller follower to operably associate the pivot link with the first arm so that as the pivot link rotates about the second pivot the roller follower moves relative to the first arm within the cam track and bears on the first arm through the cam track to cause the first arm to rotate about the first pivot.

20. The press of claim 19 wherein the distance between the roller follower and the first pivot is greater when the ram is in its advanced position then when the ram is in its retracted position to provide an increased mechanical advantage of the press when the ram is adjacent its advanced position.

21. The press of claim 19 wherein the cam track is formed in a plate operably and removably connected to the first arm.

* * * * *

UNITED STATES PATENT AND TRADEMARK OFFICE

CERTIFICATE OF CORRECTION

PATENT NO. : 5,947,018
DATED : September 7, 1999
INVENTOR(S) : Gerrit W. Sloat et al It is certified that error appears in the above-identified patent and that said Letters Patent is hereby corrected as shown below:

Col 5, Line 31, change "arms" to -- arm, --.

Col 6, Line 33, change "on" to -- one --.

Col 6, Line 39, change "arms" to -- arm, --.

Col 6, Line 48, change "then" to -- than --.

Signed and Sealed this

Twenty-third Day of May, 2000

*Attest:*

Q. TODD DICKINSON

*Attesting Officer*

*Director of Patents and Trademarks*